United States Patent [19]

Lezcano

[11] 4,302,213

[45] Nov. 24, 1981

[54] FUEL COMPOSITIONS CONTAINING ALCOHOL AND SAPONIFIED FATTY MATERIAL AND METHOD OF PREPARING SAME

[76] Inventor: Miguel R. Lezcano, 5414 Park Ave., West New York, N.J. 07093

[21] Appl. No.: 108,140

[22] Filed: Jul. 23, 1980

[51] Int. Cl.[3] ..... C10L 1/18

[52] U.S. Cl. ..... 44/56; 44/57; 44/58; 252/41

[58] Field of Search ..... 44/58, 66, 53, 57; 252/41

[56] References Cited

U.S. PATENT DOCUMENTS

| | | | |
|---|---|---|---|
| 1,432,178 | 10/1922 | Greenstreet | 44/57 |
| 2,194,496 | 3/1940 | Christensen | 44/58 |
| 2,514,312 | 7/1950 | Christ | 44/68 |
| 2,603,557 | 7/1952 | Roush | 44/56 |

*Primary Examiner*—Jacqueline V. Howard

*Attorney, Agent, or Firm*—Gloria K. Koenig

[57] ABSTRACT

Internal combustion engine fuels comprising solutions of ethyl alcohol containing dissolved saponified grease and solutions of gasoline and ethyl alcohol containing dissolved saponified grease. The method of preparing the solutions comprises predissolving saponified grease in ethanol and then combining the dissolved saponified grease with ethanol or with a combination of ethanol and gasoline.

6 Claims, No Drawings

FUEL COMPOSITIONS CONTAINING ALCOHOL AND SAPONIFIED FATTY MATERIAL AND METHOD OF PREPARING SAME

BACKGROUND OF THE INVENTION (1) Field of the Invention

This invention relates to a new fuel for internal combustion engines formed by mixing alcohol with saponified fatty material, which solution can be used as a fuel by itself or in combination with gasoline. The use of the products of this invention will greatly reduce the need for gasoline to run the automobiles and other internal combustion machines in our country.

(2) Desription of the Prior Art

Methods of mixing alcohol with different oils, gas-oil, and some solvents for use as fuels or fuel additives are known, specifically as described in U.S. Pat. Nos. 1,420,622; 1,469,148; 2,646,348; 4,036,604; and 4,177,768. However, none of the formulations disclosed are based on saponified fatty material as an additive.

SUMMARY OF THE INVENTION

The present invention relates to a method of preparing and the products formed by mixing saponified fatty material in alcohol for use as a fuel for internal combustion engines by itself or in combination with gasoline. Commercially available saponified fatty material is dissolved in heated ethanol and a quantity of the saponified fatty material-alcohol solution is added to ethanol. The saponified fatty material dissolves completely in the ethanol and does not separate at low temperatures, thus forming a fuel which is completely stable from low through fuel burning temperatures. It has been found that fatty material products that have not been through the process of saponification will separate from the alcohol at low temperatures, which results in a very defective fuel.

The internal combustion engine in which this new composition of fuel is used does not overheat because the saponified fatty material, having the characteristics of a soap in a liquid state, cleans the engine of any dirt or carbon residue left by previously used fuels. Further, when the saponified fatty material in the alcohol is burned in the engine, it appears to leave a very light lubricating film on the engine parts, thus allowing the engine to work at greater efficiency.

In addition, the alcohol and saponified fatty material solution may be combined with gasoline to provide an efficient fuel while reducing the amount of gasoline necessary to operate the engine.

DESCRIPTION OF THE PREFERRED EMBODIMENTS

The alcohol used in the present invention is completely denatured 199 proof anhydrous ethanol, such as that sold under the Trademark "Corn Power", with the following typical analysis:

| | |
|---|---|
| Apparent proof | 199 (min.) |
| Formulation (BATF Regulations): | CDA-19 |
| Flash Point | 60° F. |
| Pounds/Gallon 60° F. | 6.60-6.63 |
| Specific Gravity 60° F. | 0.794 |
| Color | Colorless |

The saponified fatty material is of 69% purity, the remaining 31% being chemical components used to saponify a fatty material and water combination. The saponified fatty material used in my tests has the following characteristics:

| | |
|---|---|
| Sodium Chloride (Na Cl) | 0.5% |
| Sodium Hydroxide (NaOH) | 0.10% |
| Glycerine | 0.5% |

The saponified fatty material for the preparations herein described was obtained from the Colgate-Palmolive Company and was prepared by saponifying rendered meat fat, but it is believed that products formed by the saponification of vegetable oils will work in the same way as described herein.

According to the process of this invention, one part by weight of saponified fatty material is combined with two parts by weight of ethanol in a container which is then placed in a water bath maintained at just below the boiling temperature (100° C.) of water for a period of approximately 2 hours during which time the saponified fatty material dissolves completely in the ethanol. As stated above, the saponified fatty material-alcohol solution thus formed is completely stable at low temperatures. The saponified fatty material-alcohol solution was then added to pure ethanol and ethanol-gasoline mixtures in various proportions and drive tested in both six and eight cylinder automobiles. In all examples the cars ran smoothly during test drives. In addition, after the test drives were completed, the engines were dismantled and were found to be cleaned of all filth and carbon residue and also appeared to be coated with a light film of lubricant which enhanced smooth operation.

EXAMPLE 1

99 parts by volume of 199 proof ethanol were mixed with 1 part by volume of saponified fatty material-alcohol solution at room temperature. The fuel composition formed operated satisfactorily in six and eight cylinder automobile engines.

EXAMPLE 2

99.6 parts of 199 proof ethanol and 0.4 part of saponified fatty material-alcohol solution on a volume basis were mixed at room temperature. The fuel composition formed operated satisfactorily in six and eight cylinder automobile engines.

EXAMPLE 3

94 parts of 199 proof ethanol and 6 parts of saponified fatty material-alcohol solution on a volume basis were mixed at room temperature. The fuel composition formed operated satisfactorily in six and eight cylinder automobile engines.

EXAMPLE 4

80 parts of 199 proof ethanol, 19 parts gasoline and 1 part saponified fatty material-alcohol solution on a volume basis were mixed at room temperature. The fuel composition formed operated satisfactorily in six and eight cylinder automobile engines.

EXAMPLE 5

80.6 parts of 199 proof ethanol, 19 parts gasoline and 0.4 part saponified fatty material-alcohol solution on a volume basis were mixed at room temperature. The fuel composition formed operated satisfactorily in six and eight cylinder automobile engines.

EXAMPLE 6

75 parts of 199 proof ethanol, 19 parts gasoline and 6 parts of saponified fatty material-alcohol solution on a volume basis were mixed at room temperature. The fuel composition formed operated satisfactorily in six and eight cylinder automobile engines.

The amounts of each ingredient in the foregoing compositions can be varied within the limits set forth. Further, all tests in Examples 4 through 6 operated satisfactorily with regular, premium, high octane and no-lead gasolines. The examples set out above may also be expressed in terms of percentages since each example comprises a total of 100 parts.

I claim:

1. A process for making an internal combustion engine fuel comprising:

(a) Dissolving one part by weight of saponified fatty material in two parts by weight of ethanol to form a saponified fatty material-alcohol solution; and (b) Mixing between 0.4% and 6% by volume of the saponified fatty material-alcohol solution with between 99.6% and 94% by volume of 199 proof ethanol.

2. The process of claim 1 wherein between 0.4% and 6% by volume of the saponified fatty material-alcohol solution is added to between 80.6% and 75% by volume of 199 proof ethanol and 19% by volume of gasoline.

3. The product of the process of claim 1.

4. The product of the process of claim 2.

5. The product of the process of claim 1 wherein said product contains about 1% by volume of saponified fatty material-alcohol solution and about 99% by volume of 199 proof ethanol.

6. The product of the process of claim 2 wherein said product contains about 1% by volume of saponified fatty material-alcohol solution, about 80% by volume of 199 proof ethanol and about 19% by volume of gasoline.

* * * * *